US010111528B1

(12) United States Patent
Mabon et al.

(10) Patent No.: US 10,111,528 B1
(45) Date of Patent: Oct. 30, 2018

(54) ELASTOMERIC WEBBING SHEET ATTACHMENT TO METAL FRAME

(71) Applicant: L&P Property Management Company, South Gate, CA (US)

(72) Inventors: Lewis A. Mabon, Trinity, NC (US); Allen R. Sigmon, High Point, NC (US)

(73) Assignee: L&P Property Management Company, South Gate, CA (US)

( * ) Notice: Subject to any disclaimer, the term of this patent is extended or adjusted under 35 U.S.C. 154(b) by 0 days.

(21) Appl. No.: 15/618,775

(22) Filed: Jun. 9, 2017

(51) Int. Cl.
*A47C 7/28* (2006.01)

(52) U.S. Cl.
CPC ..... *A47C 7/282* (2013.01)

(58) Field of Classification Search
CPC ..... A47C 7/282; A47C 7/28; A47C 7/285; A47C 7/287; A47C 7/32
USPC ..... 297/452.18, 452.63, 452.56; 160/371, 160/404
See application file for complete search history.

(56) References Cited

U.S. PATENT DOCUMENTS 3,039,763 A * 6/1962 Staples ..... A47C 7/22 267/107
3,375,861 A * 4/1968 Marlow ..... A47C 7/282 160/371
3,695,706 A * 10/1972 Basher ..... A47C 7/22 297/452.56
3,844,080 A * 10/1974 Brock ..... E04B 9/303 52/222
4,752,976 A * 6/1988 Fanning ..... A47C 17/225 5/13
9,078,524 B2 7/2015 Bullard
9,560,916 B1 2/2017 Bullard
2005/0200189 A1* 9/2005 Schultz ..... A47C 7/282 297/452.56
2013/0255895 A1* 10/2013 Toledo ..... E06B 3/80 160/371

* cited by examiner

*Primary Examiner* — Mark R Wendell
(74) *Attorney, Agent, or Firm* — Wood, Herron & Evans, LLP

(57) ABSTRACT

A seating product is provided which includes a metal frame having four sides, at least two sides each including a plurality of frame holes. The seating product also includes an elastomeric sheet webbing having first and second end loops each including a plurality of end loop holes. The seating product further includes first and second stabilizer rods extending through the first and second end loops, respectively. The seating product also includes a plurality of fasteners having first and second ends, the first ends extending through corresponding end loop holes in one of the first end loop or the second end loop and the second ends extending through corresponding frame holes in the metal frame. At least one of the fasteners contacts the respective stabilizer rod.

19 Claims, 7 Drawing Sheets

ELASTOMERIC WEBBING SHEET ATTACHMENT TO METAL FRAME

FIELD OF THE INVENTION

The present invention relates generally to furniture products and, more particularly, to seating products.

BACKGROUND OF THE INVENTION

Webbing is commonly attached to a furniture frame member by hand. The webbing is typically attached to one side of a wooden frame by staples. The user then stretches the webbing across the frame and staples it to the other side of the wooden frame. This step is repeated for the desired number of pieces of webbing to be attached to the wooden frame. This process is slow and time-consuming. Further, the process does not provide consistent tension of the webbings across the frame.

Sometimes metal (e.g., steel) frames are used in seating applications with elastomeric webbing for strength and durability purposes. In certain applications, such as the contract and medical seating industries, a seating structure must be durable enough to pass stringent cycle and drop tests, such as the ANSI/BIFMA X5.1 Office Chair Test or the ANSI/BIFMA X5.4 Lounge and Public Seating Test. For purposes of passing these tests, traditional methods of attaching a strap of webbing to a steel frame have proven to be a weakness in terms of cost and/or durability.

One type of known method of attaching webbing to steel frames is to sew the webbing into a large loop, which would then be stretched over the width or depth of the steel frame. This method requires twice the length of webbing as other methods, which can make it cost-prohibitive.

A more common method has been to attach multiple individual narrow (e.g., between approximately 2 inches and approximately 3 inches) web straps. Such straps are traditionally attached to a steel frame by means of several variations of triangular wire hooks, either clamped or sewn to the web straps, with each hook end inserted into a corresponding hole in the steel frame. Typically, approximately 4 or 5 straps are used per seat. Improved methods of attaching multiple individual web straps to a steel frame are described in U.S. Pat. Nos. 9,078,524 and 9,560,916.

Such methods require the fabrication and installation of multiple individual web straps for a single seat and thus have a relatively low efficiency. In addition, the multiple individual web straps may provide uneven support to an occupant of the seat and thus may cause discomfort. To address this, it is sometimes preferred to unitize the individual web straps, which requires additional fabrication and labor.

Consequently, there is a need for an improved sheet webbing attachment to a metal frame.

SUMMARY OF THE INVENTION

According to one embodiment of the present invention, a seating product is provided which includes a metal frame having four sides, at least two sides each including a plurality of frame holes. The seating product also includes an elastomeric sheet webbing having first and second end loops each including a plurality of end loop holes. The seating product further includes first and second stabilizer rods extending through the first and second end loops, respectively. The seating product also includes a plurality of fasteners having first and second ends, the first ends extending through corresponding end loop holes in one of the first end loop or the second end loop and the second ends extending through corresponding frame holes in the metal frame. At least one of the fasteners contacts the respective stabilizer rod. Each of the first ends may be positioned behind the respective stabilizer rod.

The elastomeric sheet webbing may be a knit and/or woven material, and may have a width of between approximately 20 inches and approximately 21 inches. The frame holes may be spaced apart from each other by between approximately 4 inches and approximately 5 inches Each of the first and second stabilizer rods may include first and second end loops. At least one of the fasteners may comprise at least one of a c-ring, a c-shaped connector, an o-shaped connector, an s-shaped connector, an oyster ring, a wire tie, or a clip. At least one of the fasteners may be rigid.

According to another embodiment of the present invention, a seating product is provided which includes metal frame having four sides, at least two sides each including a plurality of frame holes. The seating product also includes an elastomeric sheet webbing having first and second end loops each including upper and lower portions. A plurality of upper end loop holes are positioned on the upper portion and a plurality of lower end loop holes are positioned on the lower portion directly below corresponding upper end loop holes. The seating product further includes first and second stabilizer rods extending through the first and second end loops, respectively. The seating product also includes a plurality of c-rings having first and second ends, the first ends extending through corresponding upper and lower end loop holes in one of the first end loop or the second end loop and the second ends extending through corresponding frame holes in the metal frame. At least one of the c-rings contacts the respective stabilizer rod and each of the first ends is positioned behind the respective stabilizer rod.

According to yet another embodiment of the present invention, a method of attaching an elastomeric sheet webbing to a metal frame is provided, the metal frame having four sides, at least two sides each including a plurality of frame holes, the elastomeric sheet webbing having first and second end loops each including a plurality of end loop holes. The methods includes inserting first and second stabilizer rods through the first and second end loops, respectively. The method also includes inserting first ends of a first plurality of fasteners through corresponding end loop holes in the first end loop such that at least one of the first plurality of fasteners contacts the first stabilizer rod, and inserting second ends of the first plurality of fasteners through corresponding frame holes in the metal frame. The method further includes stretching the elastomeric sheet webbing from a relaxed condition to a stretched condition. The method also includes inserting first ends of a second plurality of fasteners through corresponding end loop holes in the second end loop such that at least one of the second plurality of fasteners contacts the second stabilizer rod, and inserting second ends of the second plurality of fasteners through corresponding frame holes in the metal frame.

These and other objects and advantages of the present invention will be apparent from the following detailed description of the embodiments which are illustrated in the drawings, in which:

DETAILED DESCRIPTION OF THE DRAWINGS

Figure 1:
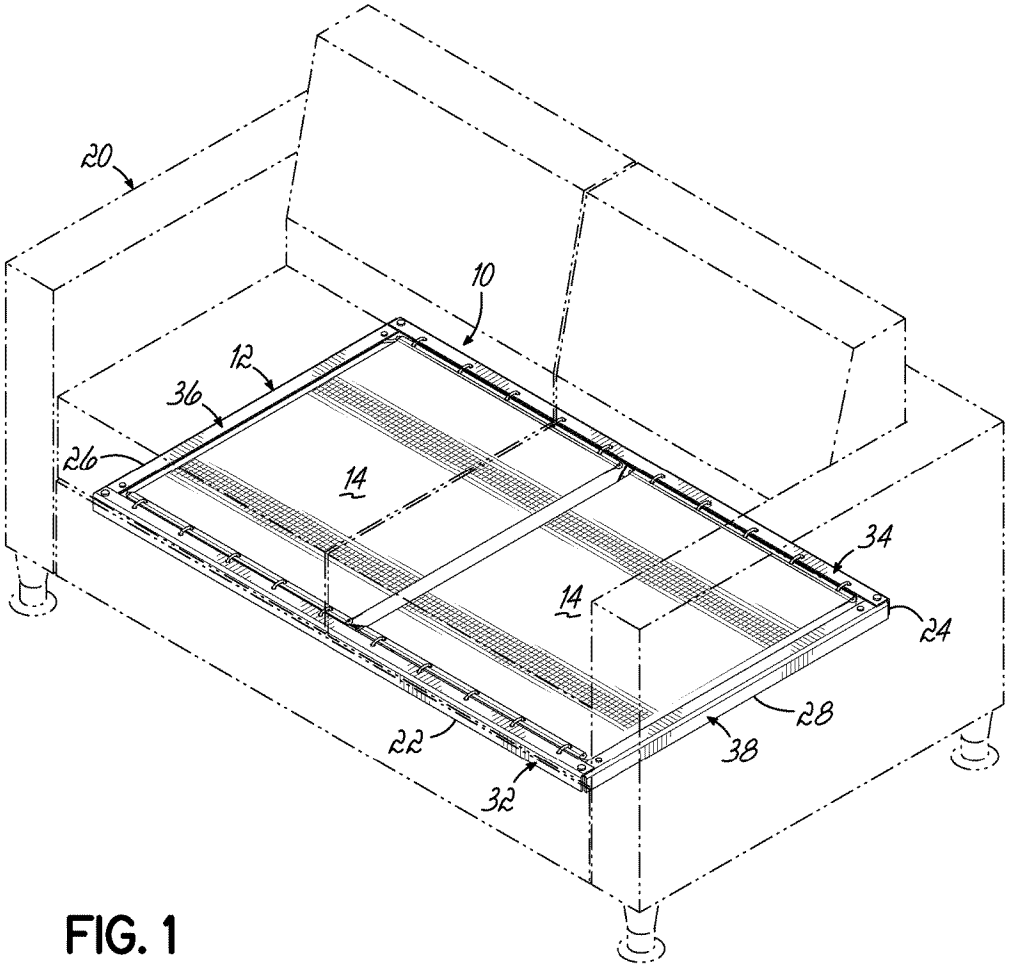
FIG. 1 is a perspective view of an exemplary seating product mounted within a loveseat, shown in phantom.

Referring to the drawings, and particularly to FIG. 1, an exemplary seating product 10 made in accordance with the present invention comprises a generally rectangular frame 12 and at least one elastomeric sheet webbing 14. The seating product 10 may comprise either a seat section or a back section of a seating product, such as a loveseat 20, or any other component of furniture. As shown, two elastomeric sheet webbings 14 may be arranged side-by-side for use in the illustrated loveseat 20. In one embodiment, each elastomeric sheet webbing 14 may be a knit or woven material, and may have a width of between approximately 20 inches and approximately 21 inches. However, other materials and/or sizes of the webbing 14 may be used.

Figure 2:
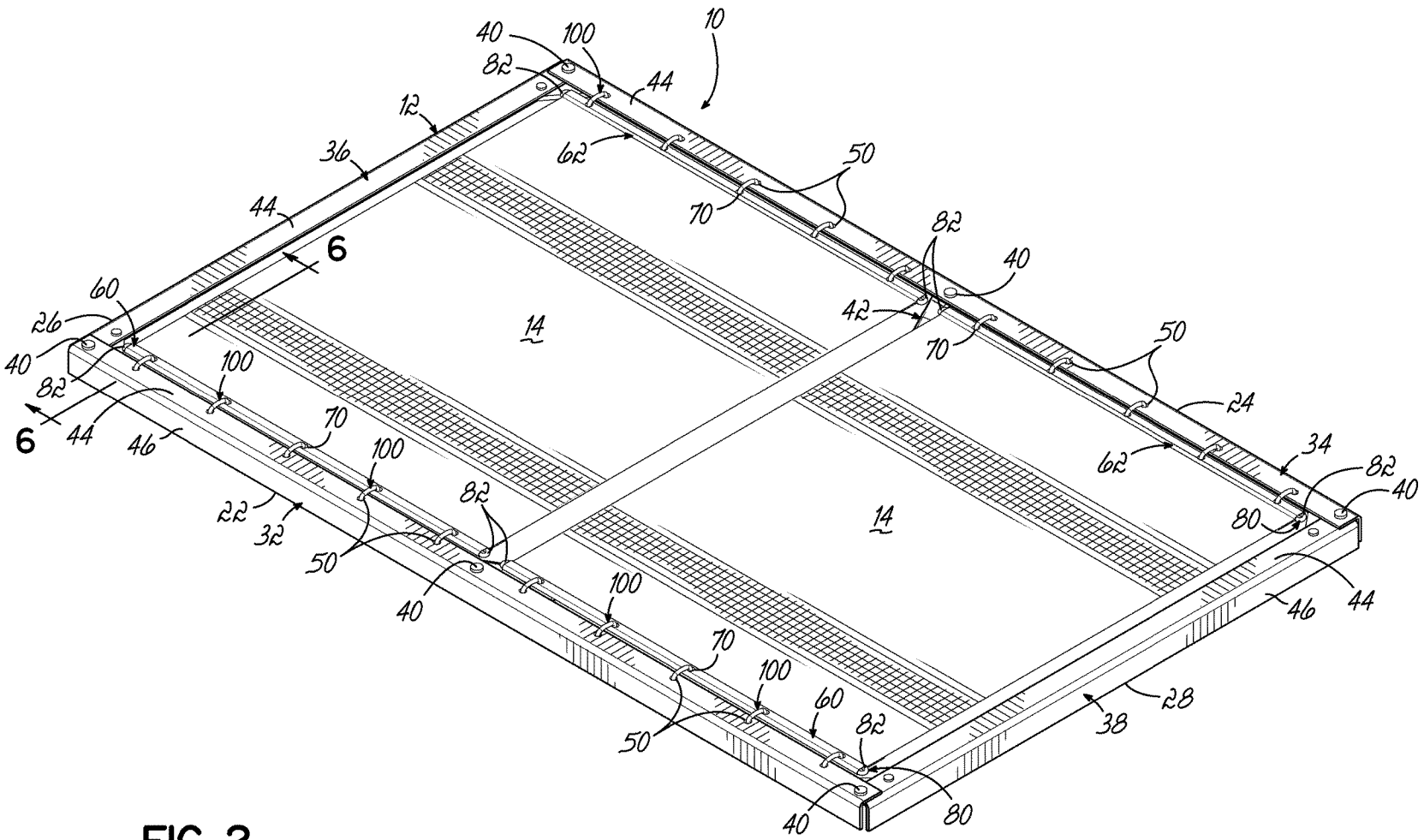
FIG. 2 is a magnified view of the seating product of FIG. 1 with the loveseat removed.
Figure 2A:
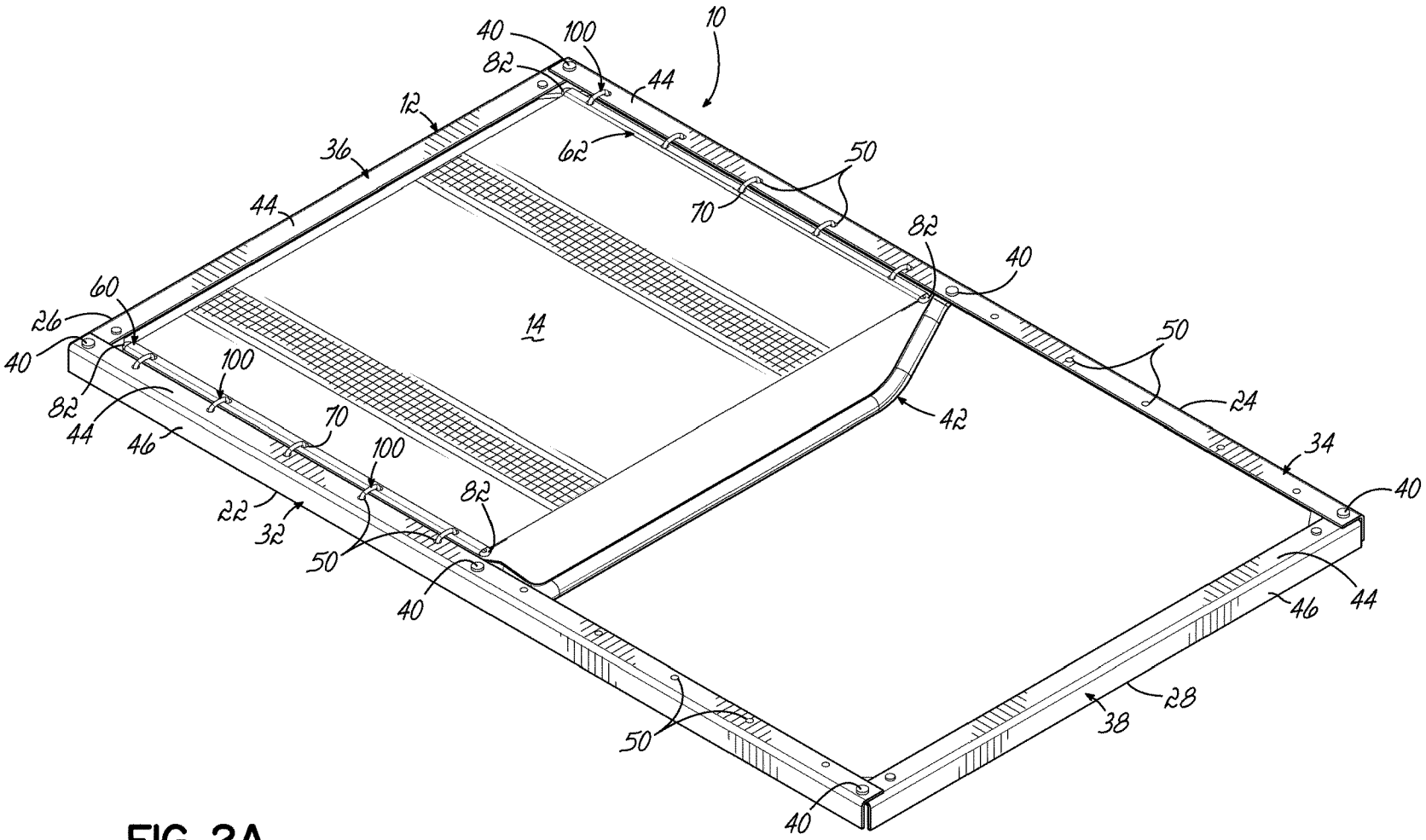
FIG. 2A is a magnified view similar to FIG. 2 with one of the elastomeric sheet webbings removed.

As shown, the frame 12 has four sides, a front 22, a rear 24, and two opposed sides 26, 28. In the illustrated embodiment, the frame 12 comprises four rails 32, 34, 36, 38 coupled together, each comprising one of the front 22, the rear 24, and the two opposed sides 26, 28. The rails 32, 34, 36, 38 may be coupled together in any suitable manner, such as by rivets 40 or by welding. As best shown in FIG. 2A, the frame 12 further comprises a tubular stretcher rail 42 extending between the front and rear rails 32, 34 and dividing the seating product 10 into two sections corresponding to the two elastomeric sheet webbings 14. For example, the tubular stretcher rail 42 may be generally centered between the side rails 36, 38 to divide the seating product 10 into halves. It will be appreciated that for other furniture configurations, such as a chair, the size of the frame 12 may be reduced from that shown and the tubular stretcher rail 42 may be eliminated. For still other furniture configurations, such as a sofa, the size of the frame 12 may be increased from that shown and a second tubular stretcher rail 42 may be used to divide the seating product 10 into three sections, such as thirds. Alternatively, multiple frames 12 generally sized and configured for a chair may be coupled together side-by-side, such as by riveting or welding, for use in a loveseat or sofa.

As best shown in FIGS. 2, 2A, 3, and 6, each of the rails 32, 34, 36, 38 comprises an angle iron having a generally L-shaped cross-section and including a top wall 44 and a side wall 46 extending downwardly from an outer edge of the top wall 44. It will be appreciated that other configurations of the components of the frame 12 may be utilized. For example, each of the rails 32, 34, 36, 38 may be a hollow tube and may have a generally rectangular cross-section. In any event, a plurality of holes 50 are provided in each of the front and rear rails 32, 34. As shown, the holes 50 are spaced apart along the length of each of the front and rear rails 32, 34 at equal intervals on the top walls 44. For example, the holes 50 may be spaced apart from each other by between approximately 4 inches and approximately 5 inches. In the embodiment shown, ten holes 50 are provided in each of the front and rear rails 32, 34, with five holes 50 in each of the rails 32, 34 in each of the two sections of the seating product 10. However, it will be appreciated that more or less holes 50 may be used. In addition, or alternatively, holes similar to the illustrated holes 50 may be provided in the side rails 36, 38.

Figure 3:
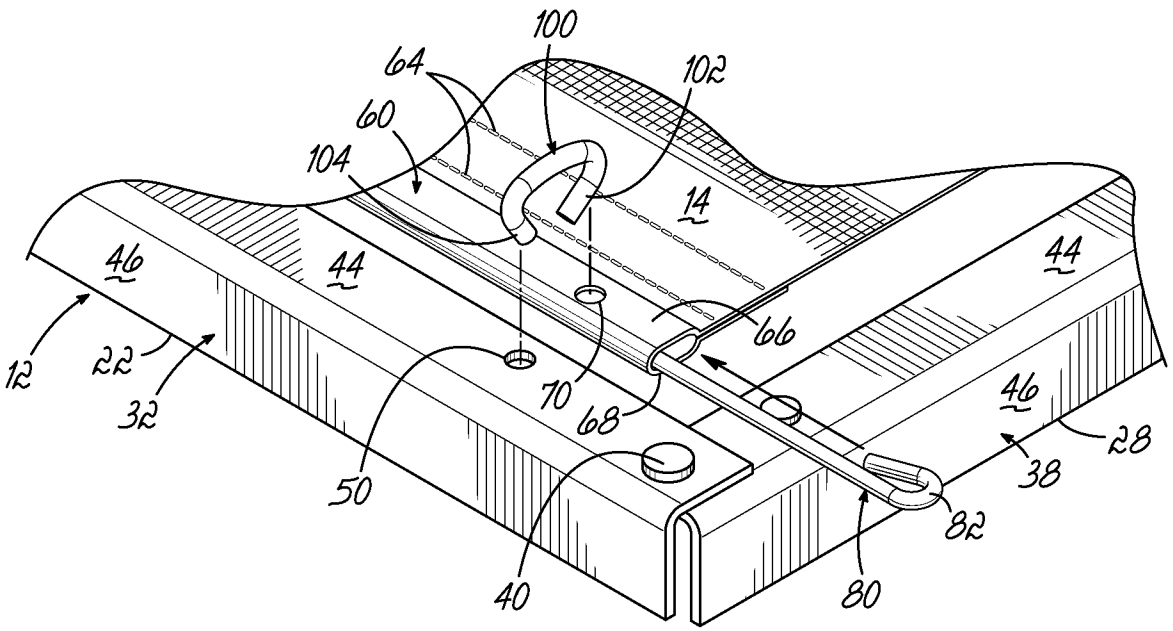
FIG. 3 is a detail view of a portion of the seating product of FIG. 1 illustrating aspects of the assembly of the seating product.
Figure 6:
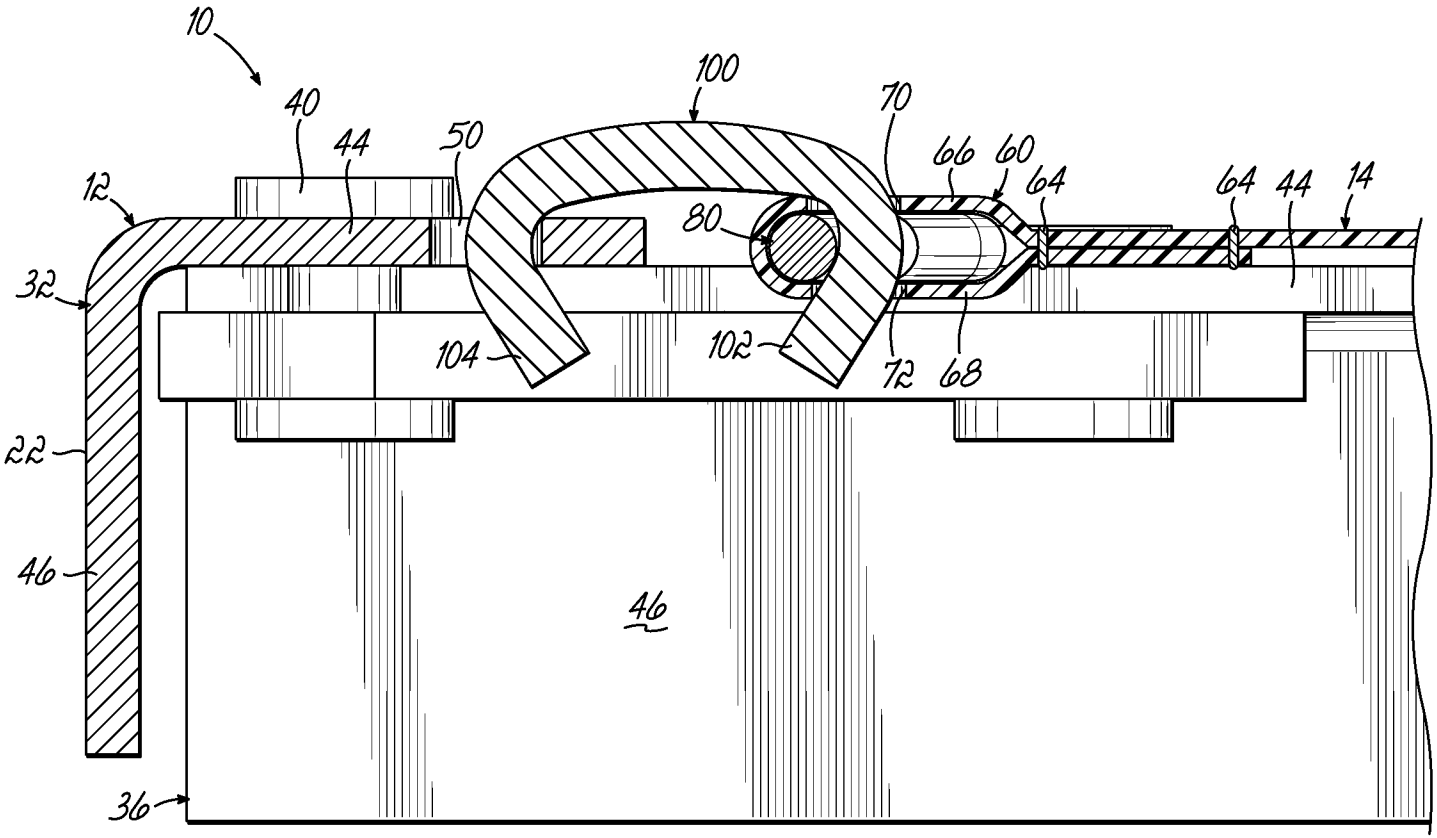
FIG. 6 is a cross-sectional view of the seating product of FIG. 1 taken along section line 6-6 in FIG. 2.

As shown, each elastomeric sheet webbing 14 has opposed end loops 60, 62, each end loop 60, 62 being created by sewing or otherwise securing the elastomeric sheet webbing 14 to itself along one or more seams 64 (FIG. 3). Thus, each end loop includes an upper portion 66 and a lower portion 68. A plurality of holes 70, 72 are spaced apart along the length of each of the upper and lower portions 66, 68 of each of the end loops 60, 62 at equal intervals, and at locations corresponding to the locations of the holes 50 on the rails 32, 34 for alignment therewith. For example, the holes 70, 72 in each of the upper and lower portions 66, 68 may be spaced apart from each other by between approximately 4 inches and approximately 5 inches. As shown in FIG. 6, the holes 72 provided in each lower portion 68 are each positioned directly below a corresponding hole 70 in the respective upper portion 66. In the embodiment shown, five holes 70, 72 are provided in each of the upper and lower portions 66, 68 such that five pairs of holes 70, 72 are provided in each of the end loops 60, 62, corresponding to the five holes 50 in each of the front and rear rails 32, 34 in each half of the seating product 10. However, it will be appreciated that more or less holes 70, 72 may be used depending, for example, on the number of holes 50 in each of the front and rear rails 32, 34. In one embodiment, the holes 70, 72 may be formed by burning the elastomeric sheet webbing 14.

As best shown in FIG. 3, a stabilizer rod 80 is inserted into each of the end loops 60, 62 and extends substantially the entire length thereof. In other words, the length of each stabilizer rod 80 may be approximately equal to the width of the elastomeric sheet webbing 14. The stabilizer rods 80 are configured to be positioned forward of the holes 70, 72 in the respective end loop 60, 62 (e.g., outwardly of the holes 70, 72 relative to the elastomeric sheet webbing 14). Each stabilizer rod 80 may be constructed of a material and/or gauge similar to a conventional border rod or border wire of an article of furniture. For example, each stabilizer rod 80 may be a black poly fluted 12 gauge oil tempered border wire or a 9 gauge galvanized high carbon wire border rod.

As shown, each stabilizer rod 80 has opposed eyelets 82, each eyelet 82 being created by bending an end portion of the stabilizer rod 80 over itself. The eyelets 82 may each provide a rounded contact point between the stabilizer rod 80 and the respective end loop 60, 62 as the stabilizer rod 80 is inserted therethrough, and thus prevent the stabilizer rod 80 from piercing or otherwise damaging the end loop 60, 62. In addition or alternatively, the eyelets 82 may prevent the stabilizer rod 80 from rotating or otherwise shifting within the end loop 60, 62 after the stabilizer rod 80 has been positioned therein. For example, each eyelet 82 may be sized to tightly fit within the respective end loop 60, 62 so as to constrain movement of the stabilizer rod 80 within the end loop 60, 62.

A plurality of fasteners such as c-rings 100 are inserted through aligned holes 50, 70, 72 in the frame 12 and end loops 60, 62 to couple the elastomeric sheet webbings 14 to the frame 12. For example, each c-ring 100 may include first and second ends 102, 104, and may be substantially rigid. Each c-ring 100 may be inserted into a pair of holes 70, 72 in an end loop 60, 62 such that the first end 102 extends through each of the upper and lower holes 70, 72 of the pair (FIG. 6). When so inserted, each first end 102 is positioned behind the stabilizer rod 80 in the respective end loop 60, 62 (e.g., inwardly of the stabilizer rod 80 relative to the elastomeric sheet webbing 14). Likewise, each c-ring 100 may be inserted into a corresponding hole 50 in the frame 12 such that the second end 104 extends through the hole 50. It will be appreciated that any other suitable fastener may be used, such as a c-shaped connector, an o-shaped connector, an s-shaped connector, an oyster ring, a wire tie, or a clip. In any event, as shown the elastomeric sheet webbing 14 may be initially coupled to the front rail 32 of the frame 12 and may be in a relaxed condition.

Figure 4:
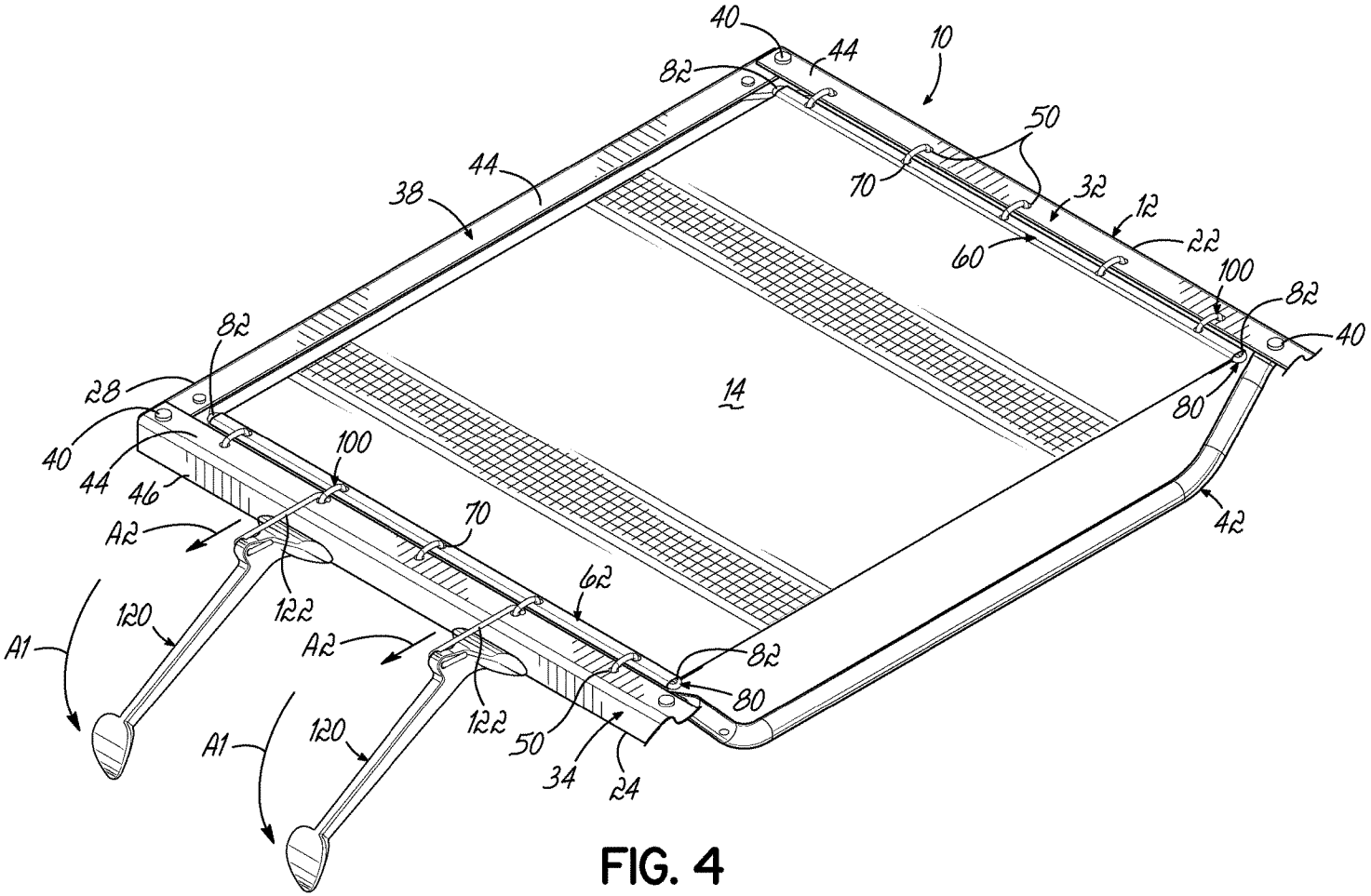
FIG. 4 is a perspective view of a portion of the seating product of FIG. 1 illustrating another aspect of the assembly of the seating product.
Figure 5:
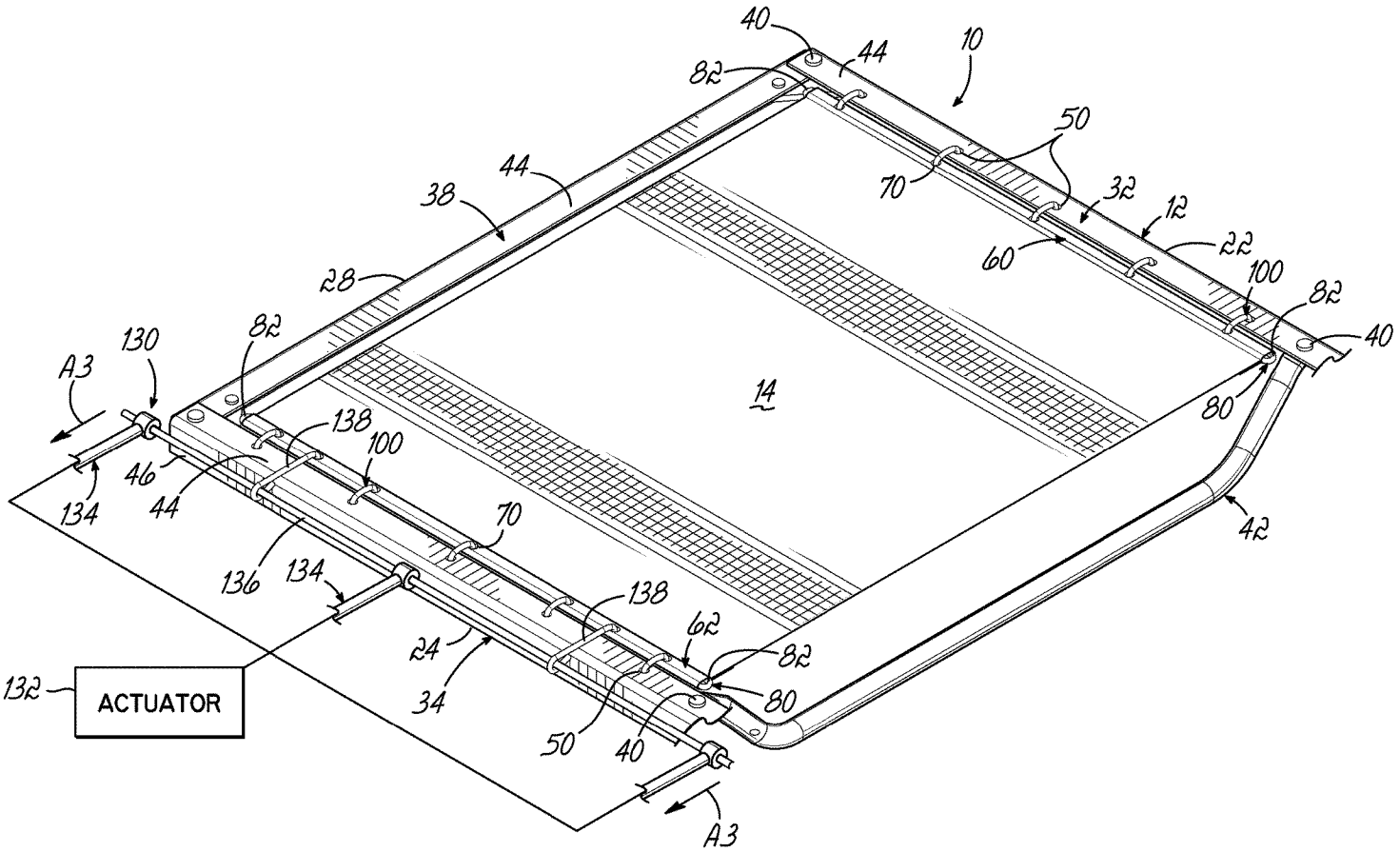
FIG. 5 is a perspective view similar to FIG. 4 illustrating an alternative aspect of the assembly of the seating product.

As shown in FIGS. 4 and 5, once the elastomeric sheet webbing 14 is coupled to the front rail 32 via the c-rings 100 and holes 50, 70, 72 at that end of the frame 12, the elastomeric sheet webbing 14 is stretched from the relaxed condition to a stretched condition. The c-rings 100 at the opposite end of the elastomeric sheet webbing 14 are each inserted into a pair of holes 70, 72 in the rear end loop 62, such that the first end 102 extends through each of the upper and lower holes 70, 72 of the pair, and are each inserted into a corresponding hole 50 in the rear rail 34, such that the second end 104 of each c-ring 100 extends through the hole 50. The tension created by the stretched elastomeric sheet webbing 14 locks the c-rings 100 on both ends of the frame 12 into position to securely couple the elastomeric sheet webbing 14 to both ends of the frame 12.

In the embodiment shown in FIG. 4, the elastomeric sheet webbing 14 is stretched via a hand tool, such as one or more lever tools 120 removably coupled to one or more c-rings 100 by corresponding hooks 122. The lever tools 120 are manually pivoted relative to the frame 12 by a user, as indicated by the arrows A1, to pull the respective end of the elastomeric sheet webbing 14 toward the rear rail 34, as indicated by the arrows A2, so that the c-rings 100 may be inserted into the corresponding holes 50 on the rear rail 34. Once the c-rings 100 have been inserted, the lever tools 120 and hooks 122 may be removed.

Alternatively, in the embodiment shown in FIG. 5, the elastomeric sheet webbing 14 is stretched via an automated pulling assembly 130 including an actuator 132. The actuator 132 is configured to retract one or more arms 134 which carry a yoke 136. The yoke 136 is removably coupled to the elastomeric sheet webbing 14 by one or more hooks 138, which may pierce or otherwise engage the elastomeric sheet webbing 14. In one embodiment, the hooks 138 may engage the elastomeric sheet webbing 14 behind the stabilizer rod 80 (e.g., inwardly of the stabilizer rod 80 relative to the elastomeric sheet webbing 14). In any event, the actuator 132 may be activated to pull the respective end of the elastomeric sheet webbing 14 toward the rear rail 34, as indicated by the arrows A3, so that the c-rings 100 may be inserted into the corresponding holes 50 on the rear rail 34. Once the c-rings 100 have been inserted, the automated pulling assembly 130 may be removed. The automated pulling assembly 130 may provide greater pulling force than would be otherwise achievable by a hand tool and may be used in applications where the elastomeric sheet webbing 14 must be stretched a significant amount, such as in applications where the elastomeric sheet webbing 14 must be stretched approximately 100%. In this regard, it will be appreciated that the amount of stretching required for a particular application may be dependent on the length of the elastomeric sheet webbing 14, the size of the frame 12, and/or the elasticity of the elastomeric sheet webbing 14. Differently configured elastomeric sheet webbings 14 may be used in each section of the seating product 10 to provide different degrees of support and/or required stretch.

In any event, with the c-rings 100 secured in place relative to both ends of the frame 12, the stabilizer rods 80 allow tension created by the elastomeric sheet webbing 14 to be transferred to the metal frame 12 via the c-rings 100 without tearing or otherwise damaging the elastomeric sheet webbing 14. To that end, as best shown in FIG. 6, each c-ring 100 directly contacts the stabilizer rod 80 within the respective end loop 60, 62 of the elastomeric sheet webbing 14 on an inner side of the stabilizer rod 80, such that each c-ring 100 directly pulls the respective stabilizer rod 80 outwardly relative to the elastomeric sheet webbing 14. This allows tension to be transferred directly between the c-rings 100 and the respective stabilizer rods 80 rather than relying on portions of the elastomeric sheet webbing 14 to carry tension between the c-ring 100 and the frame 12. Each stabilizer rod 80 also distributes the tension created by the elastomeric sheet webbing 14 along the length of the stabilizer rod 80 and the width of the elastomeric sheet webbing 14. Thus, the stabilizer rods 80 may also allow the elastomeric sheet webbing 14 to be tensioned evenly along the widths thereof, even though the c-rings 100 may be spaced relatively far apart from each other, such as by between approximately 4 inches and approximately 5 inches, as a result of the spacing of the holes 50, 70, 72.

Although the elastomeric sheet webbings 14 are illustrated extending from front-to-back, those skilled in the art will appreciate that the elastomeric sheet webbings 14 may extend from side-to-side. This document is not intended to limit the orientation of the frame 12 and/or elastomeric sheet webbings 14 to those illustrated. It will also be appreciated that, while two elastomeric sheet webbings 14 are illustrated corresponding to the two halves of the seating product 10, any number of elastomeric sheet webbings 14 may be used. For example, a single elastomeric sheet webbing 14 may be used.

Although only certain exemplary embodiments of this invention have been described in detail above, those skilled in the art will readily appreciate that various modifications can be made without departing from the principles of the present invention. Accordingly, all such modifications are intended to be included within the scope of this invention.

What is claimed is:

1. A seating product comprising:

a metal frame having four sides, each of the sides comprising an angle iron having a generally L-shaped cross-section and including a top wall and a side wall extending downwardly from the top wall, at least two sides each including a plurality of frame holes extending through the top wall of the angle iron;

an elastomeric sheet webbing having first and second end loops each including a plurality of end loop holes;

first and second stabilizer rods extending through the first and second end loops, respectively; and a plurality of c-rings having first and second ends, the first ends extending through corresponding end loop holes in one of the first end loop or the second end loop and the second ends extending through corresponding frame holes in the metal frame, wherein at least one of the c-rings contacts the respective stabilizer rod wherein each of the c-rings is oriented such that the ends of the c-ring are below a central portion of the c-ring, the second ends of the c-rings being below the top wall of the angle iron and the first ends of the c-rings being below the stabilizer rods.

2. The seating product of claim 1, wherein each of the first and second stabilizer rods includes first and second opposed eyelets.

3. The seating product of claim 1, wherein the top wall of the angle iron and the stabilizer rods are generally co-planar.

4. The seating product of claim 1, wherein each of the first and second stabilizer rods extends an entire length of the first and second end loops, respectively.

5. The seating product of claim 1, wherein the first and second end loops each include upper and lower portions, and wherein the plurality of end loop holes includes a plurality of upper end loop holes positioned on the upper portion and a plurality of lower end loop holes positioned on the lower portion.

6. The seating product of claim 5, wherein the lower end loop holes are each positioned directly below corresponding upper end loop holes.

7. The seating product of claim 1, wherein each of the first ends is positioned behind the respective stabilizer rod.

8. The seating product of claim 1, wherein the frame holes are spaced apart from each other by between approximately 4 inches and approximately 5 inches.

9. The seating product of claim 1, wherein the elastomeric sheet webbing has a width of between approximately 20 inches and approximately 21 inches.

10. The seating product of claim 1, wherein the elastomeric sheet webbing is at least one of a knit or a woven material.

11. The seating product of claim 1, wherein the metal frame comprises multiple pieces.

12. The seating product of claim 11, wherein the metal frame comprises four pieces.

13. The seating product of claim 1, wherein at least one of the c-rings is rigid.

14. A seating product comprising:

a metal frame having four sides, each of the sides comprising an angle iron having a generally L-shaped cross-section and including a generally horizontal top wall and a side wall extending downwardly from the generally horizontal top wall, at least two sides each including a plurality of frame holes extending through the top wall of the angle iron;

an elastomeric sheet webbing having first and second end loops each including upper and lower portions, wherein a plurality of upper end loop holes are positioned on the upper portion and a plurality of lower end loop holes are positioned on the lower portion directly below corresponding upper end loop holes;

first and second stabilizer rods extending through the first and second end loops, respectively; and a plurality of c-rings having first and second ends, the first ends extending through corresponding upper and lower end loop holes in one of the first end loop or the second end loop and the second ends extending through corresponding frame holes in the metal frame, wherein at least one of the c-rings contacts the respective stabilizer rod and wherein each of the first ends is positioned below the respective stabilizer rod and each of the second ends being positioned below the top wall of the angle iron.

15. The seating product of claim 14, wherein each of the first and second stabilizer rods includes first and second opposed eyelets.

16. The seating product of claim 14, wherein each of the first and second stabilizer rods extends an entire length of the first and second end loops, respectively.

17. The seating product of claim 14, wherein the elastomeric sheet webbing has a width of between approximately 20 inches and approximately 21 inches.

18. The seating product of claim 14, wherein the elastomeric sheet webbing is at least one of a knit or a woven material.

19. A method of attaching an elastomeric sheet webbing to a metal frame having four sides, at least two sides each including a plurality of frame holes, the elastomeric sheet webbing having first and second end loops each including a plurality of end loop holes, the method comprising:

inserting first and second stabilizer rods through the first and second end loops, respectively;

inserting first ends of a first plurality of fasteners through corresponding end loop holes in the first end loop such that at least one of the first plurality of fasteners contacts the first stabilizer rod;

inserting second ends of the first plurality of fasteners through corresponding frame holes in the metal frame;

stretching the elastomeric sheet webbing from a relaxed condition to a stretched condition using lever tools;

inserting first ends of a second plurality of fasteners through corresponding end loop holes in the second end loop such that at least one of the second plurality of fasteners contacts the second stabilizer rod; and inserting second ends of the second plurality of fasteners through corresponding frame holes in the metal frame.

* * * * *